US005423622A

United States Patent [19]

Perrotti

[11] Patent Number: 5,423,622

[45] Date of Patent: Jun. 13, 1995

[54] LIPSTICK HOLDER WITH MOVABLE COVERS

[76] Inventor: Dominick Perrotti, 209 Westwood Rd., Southington, Conn. 06489

[21] Appl. No.: 282,070

[22] Filed: Jul. 28, 1994

[51] Int. Cl.[6] ..... A45D 40/06; A45D 40/22

[52] U.S. Cl. ..... 401/59; 401/60; 401/108

[58] Field of Search ..... 401/59, 60, 108

[56] References Cited

U.S. PATENT DOCUMENTS

| | | | |
|---|---|---|---|
| 1,979,828 | 11/1934 | Fullmer . | |
| 2,002,716 | 5/1935 | Richter . | |
| 2,089,832 | 8/1937 | Kasdan et al. | 401/59 |
| 2,091,312 | 8/1937 | Fullmer . | |
| 2,111,767 | 3/1938 | Gimonet . | |
| 2,404,815 | 7/1946 | Satz et al. . | |
| 2,443,361 | 6/1948 | Satz et al. . | |
| 2,463,086 | 3/1949 | Chabbert . | |
| 2,552,697 | 5/1951 | Tursky . | |
| 2,610,732 | 9/1952 | Calhoun . | |
| 2,952,242 | 9/1960 | Rosso | 401/108 |
| 3,709,618 | 1/1973 | Gruska . | |
| 5,171,096 | 12/1992 | Perrotti . | |

FOREIGN PATENT DOCUMENTS

| | | | |
|---|---|---|---|
| 770006 | 9/1934 | France . | |
| 788972 | 10/1935 | France . | |
| 936151 | 7/1948 | France | 401/59 |
| 940758 | 12/1948 | France . | |
| 265348 | 11/1949 | Switzerland | 401/59 |
| 2240768 | 8/1991 | United Kingdom | 401/59 |

*Primary Examiner*—Steven A. Bratlie

[57] ABSTRACT

An easily manipulatable cosmetic stick holder has a housing with an opening at its upper end and a sidewall with opposed access apertures and a core member with a generally cylindrical sidewall having axially extending slots therein and a collar at its upper end providing horizontal shoulders with slots therein. A manipulatable tubular member having helical channels in its inner and outer surfaces is rotatably disposed about the core member and is manipulatable through the housing apertures. A carrier cup is slidable in the core member and has projections extending through the slots in the core member and into the inner helical channel of the manipulatable member. A closure member has a cylindrical body portion slidable on the manipulatable member and a projection on its inner surface is seated in the outer channel of the manipulatable member. Rotation of the manipulatable member moves the closure member and carrier cup axially in opposite directions. The closure member also has a peripheral collar portion at the upper end and closure panels pivotably supported on the collar portion which extend through the slots in the core member collar and close the housing opening when pivoted into a horizontal position by movement of the closure member into its uppermost position. Movement of the closure member downwardly causes the closure panels to pivot into a vertical position and slide downwardly in the slots of the collar to expose the opening of the housing.

18 Claims, 4 Drawing Sheets

76
42
66
54
28
70
62
16
62
18
20
38
40
10
34
12
24

76

66
42
54
70
62
16
62
20
18
10

LIPSTICK HOLDER WITH MOVABLE COVERS

BACKGROUND OF THE INVENTION

The present invention relates to holders for lipstick and other cosmetic sticks and, more particularly, to a lipstick holder in which the cover is an integral part thereof and may be opened by one hand in the same motion which moves the cosmetic stick into its exposed position.

In Applicant's prior U.S. Pat. No. 5,171,096 of Dec. 15, 1992, there is disclosed a unitary holder in which the user can open an integral cover and project the lipstick or other cosmetic stick into a usable position by manipulation with one hand in simple easy motions. Other patents which disclose unitary assemblies include Richter U.S. Pat. No. 2,002,716, Fullmer et al U.S. Pat. No. 2,091,312, Satz et al U.S. Pat. No. 2,404,815, Chabbert U.S. Pat. No. 2,463,086, Tursky U.S. Pat. No. 2,552,697, Calhoun U.S. Pat. No. 2,610,732 and Gruska U.S. Pat. No. 3,709,618.

Although Applicant's prior lipstick holder offers considerable advantages, the number of pieces required in the assembly and the resultant assembly operation have proven to be impediments to economical implementation in commercial structures. Because such holders are of necessity low cost, it is generally necessary that the number of parts be limited and be relatively simple to fabricate even though the structure may offer significant advantages in terms of ease of use.

Accordingly, it is an object of the present invention to provide a novel unitary lipstick holder which may be readily manipulated by one hand to project and retract the lipstick or other cosmetic stick.

It is also an object to provide such a cosmetic stick holder which is simple and relatively economical to fabricate and which may be readily and simply assembled.

Another object is to provide such a cosmetic stick holder which requires a minimum of separate components.

A further object is to provide such a holder which lends itself to modification in external appearance since the housing may be readily and simply formed from a variety of materials.

SUMMARY OF THE INVENTION

It has now been found that the foregoing and related objects may be readily attained in a cosmetic stick holder comprising a housing with an opening at its upper end and having a base and a sidewall with at least one access aperture therein. Seated in the housing is a core member having a generally circular cross section and having a base, and a generally cylindrical sidewall extending upwardly therefrom. The sidewall has at least one axially extending slot therein, and a collar at the upper end of the sidewall provides horizontal shoulders on opposite sides thereof with slots in such shoulders.

A manipulatable tubular member is rotatably disposed about the sidewall of the core member and is manipulatable through the housing access aperture. A generally helical channel is provided on its inner surface and another generally helical channel is provided on its outer surface. Disposed in the core member is a carrier cup of generally circular cross section and having a base and a sidewall. A projection on the outer surface of the sidewall extends through the axially extending slot in the core member and slidably seats in the inner helical channel of the manipulatable member so that rotation of the manipulatable member effects movement of the cup axially of the core member.

Slidable on the outer surface of the manipulatable member is a closure member having a cylindrical body portion with a projection on its inner surface seated in the outer channel of the manipulatable member. As a result, rotation of the manipulatable member moves the closure member axially thereon in a direction opposite from that of the movement of the carrier cup. The closure member also has a peripheral collar portion at the upper end of its body portion, and closure panels which are pivotably supported on the upper surface of the collar portion. The panels extend through the slots in the collar of the core member and are dimensioned and configured to close the housing opening when pivoted into a horizontal position. Movement of the closure member downwardly on the manipulatable member causes the closure panels to pivot into a vertical position and slide downwardly in the slots of the core member collar to expose the opening of the housing. Upon movement of the closure member into its uppermost position, the closure panels move into a horizontal position to close the opening.

Desirably, the collar of the core member seats on the upper end of the sidewall of the housing, and it has an upstanding wall extending about its periphery and within which the closure panels seat in the horizontal position. The upper portion of the housing has a rectangular cross section and the collar of the core member is of cooperating rectangular configuration.

Preferably, the sidewall of the core member includes means for rotatably supporting the manipulatable member thereon, and this conveniently comprises tabs projecting outwardly thereof on which the manipulatable member seats.

Generally, the core member has a pair of diametrically spaced axially extending slots and the carrier cup has a cooperating pair of diametrically spaced projections thereon extending through the pair of slots. In addition, the sidewall of the housing has a pair of opposed access apertures.

In the preferred structure, there is included means for securing the core member in the housing. The housing has a base wall with a pedestal upon which the base of the core member seats and a fastener extends through the pedestal and into the core member.

Desirably, the closure member collar has upstanding ribs thereon upon which the closure panels are pivotably supported, and the closure panels have projections on the sides thereof which are movable in horizontal slots in the collar of the core member during pivoting thereof between opening and closing positions.

Desirably, the outer helical channel of the manipulatable member has at least one horizontal portion to stall axial motion of the closure member during rotation of the manipulatable member.

DETAILED DESCRIPTION OF THE PREFERRED EMBODIMENTS

Figure 1:
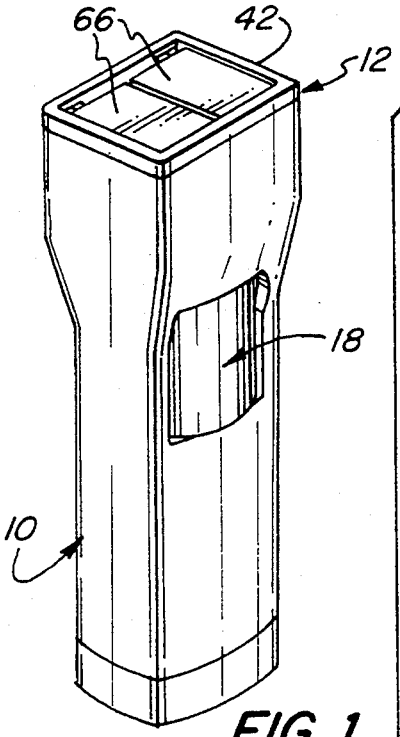
FIG. 1 is a perspective view of a cosmetic stick holder embodying the present invention.
Figure 2:
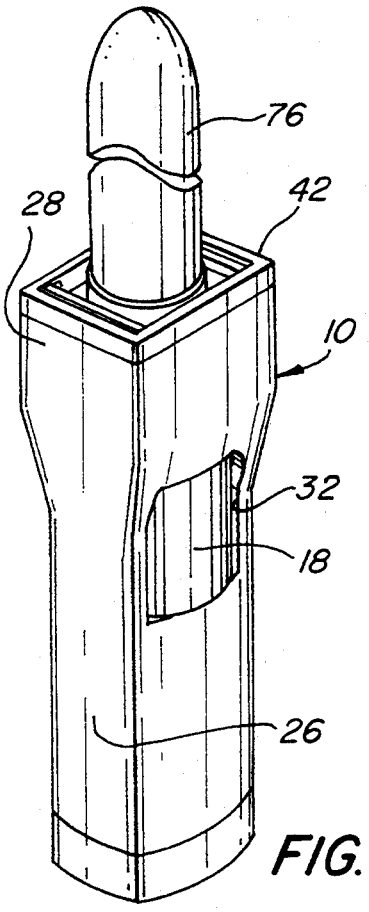
FIG. 2 is a similar view of the holder with the lipstick moved into the exposed position.
Figure 3:
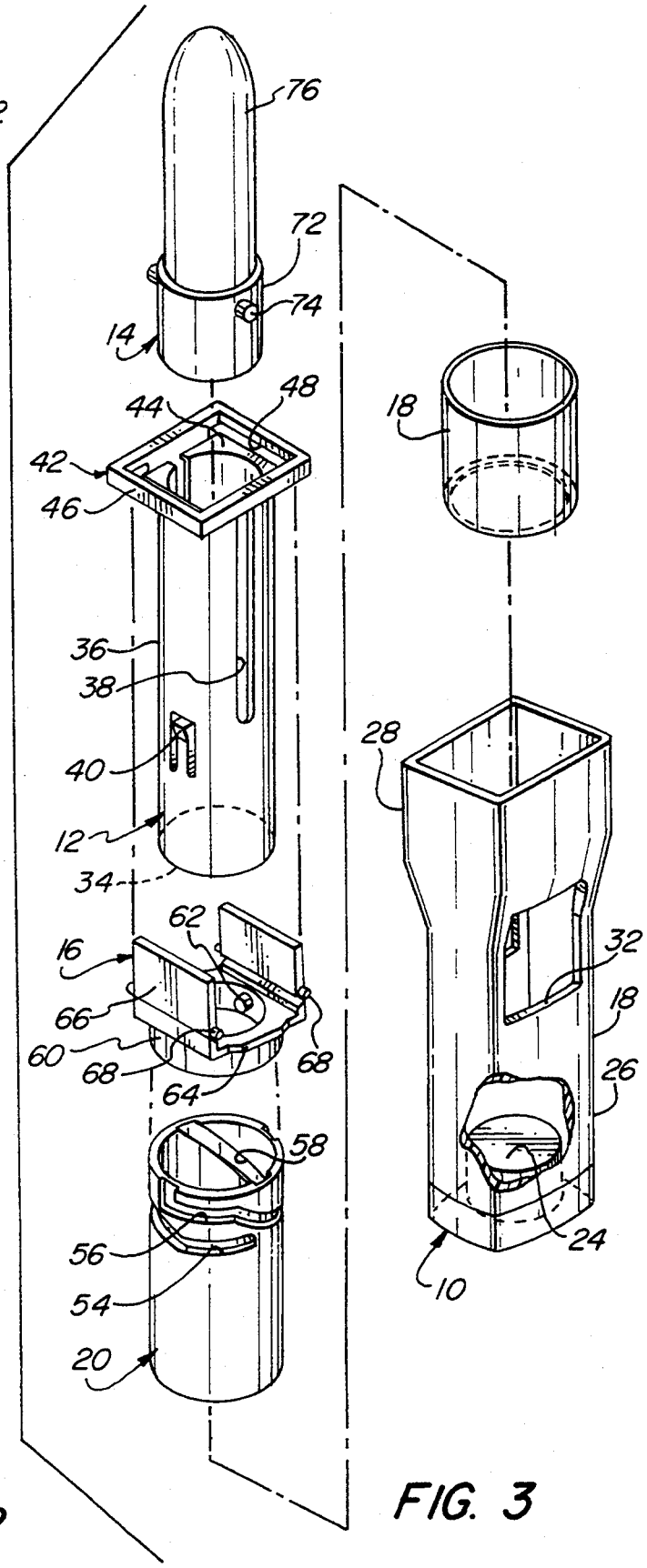
FIG. 3 is an exploded view of the holder.

Turning first to FIGS. 1–3, therein illustrated is a cosmetic stick holder embodying the present invention and having a housing generally designated by the numeral 10 within which is axially movable a cosmetic cup generally designated by the numeral 14 seating the lipstick 76. A core member generally designated by the numeral 12 is seated within the housing 10 and provides a collar 42 about the upper end of the housing 10. Rotatably supported on the core member 12 is a manipulatable member 20 which in turn supports for movement relative thereto, the closure member generally designated by the numeral 16. For cosmetic purposes, a sleeve 18 is provided about a portion of the periphery of the manipulatable member 20.

Turning in detail first to the housing 10, it is of generally rectangular cross section and has a base 22 with a pedestal portion 24, and a sidewall 26 which is enlarged at its upper end as indicated by the numeral 28. Access apertures 32 are provided in two opposed sidewall panels.

Turning next to the core member 12, it is of circular cross section and has the base wall 34 and a generally cylindrical sidewall 36 which is provided with diametrically spaced axially extending slots 38. Below the slots 38, the sidewall 36 has a pair of diametrically spaced tabs 40 which provide horizontal shoulders extending horizontally outwardly of the sidewall 36 and upon which is rotatably seated the manipulatable member 20. At the upper end of the core member 12 is a collar generally designated by the numeral 42 which provides a horizontal wall 44 extending outwardly about the sidewall 36 and a vertically extending peripheral wall 46. Slots 48 extend across the intersection of opposed peripheral wall panels 46 and the horizontal wall 44 and partially into the adjacent panels of the peripheral wall 46.

Figure 9:
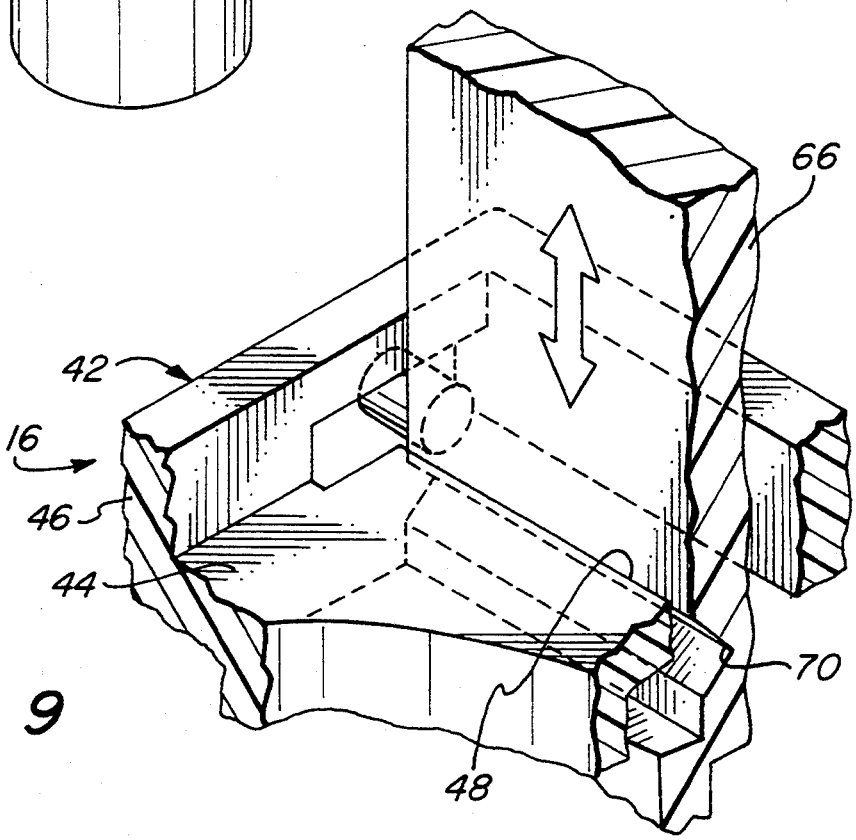
FIG. 9 is a fragmentary perspective view to a greatly enlarged scale of the upper end of the core member and a portion of the closure member.

Slidably supported on the manipulatable member 20 is the closure member 16 which has a cylindrical body portion 60 with diametrically opposed pins 62 on its inside surface. The pins 62 slidably seat in the helical channels 54 on the outer surface of the manipulatable member 20. At the upper end of the body portion 60 is a collar portion 64 which hingedly supports a pair of opposed closure panels 66 having pins 68 on the sides thereof. As best seen in FIG. 9, the closure member 16 is integrally molded with a living hinge designated by the numeral 70 between the closure panels 66 and the collar portion 64.

In assembling the parts, the carrier cup 14 is inserted into the core member 12 with its pins 74 seated in the slots 38. The closure member 16 is slid over the top of the manipulatable member 20 and its pins 62 are seated in the channel 54. The manipulatable member 20 and closure member are then slid upwardly onto the core member 12 and the tabs 40 deflect to allow the manipulatable member 20 to pass thereby. Continued upward movement is effected with the closure panels 66 in the extended position and oriented so that they pass through the slots 48 in the collar 42 of the core member 12.

The sleeve 18 may be assembled about the manipulatable member 20 either before or after its assembly with the core member 12. At this point, the core member 12 is secured in position on the pedestal 24 by adhesive.

In operation of the lipstick holder, the sleeve 18, which is desirably provided with a ribbed or other textured surface to facilitate gripping, is rotated between a thumb and finger in either direction depending upon the direction in which movement of the carrier cup 14 is desired. Upon rotation, it will be appreciated that the carrier cup 14 moves in one direction by reason of the engagement of its pins 74 in the channels 58 of the manipulatable member 12 while the closure member 16 moves in the opposite direction by reason of the engagement of its pins 62 in the channel 54.

Figure 4:
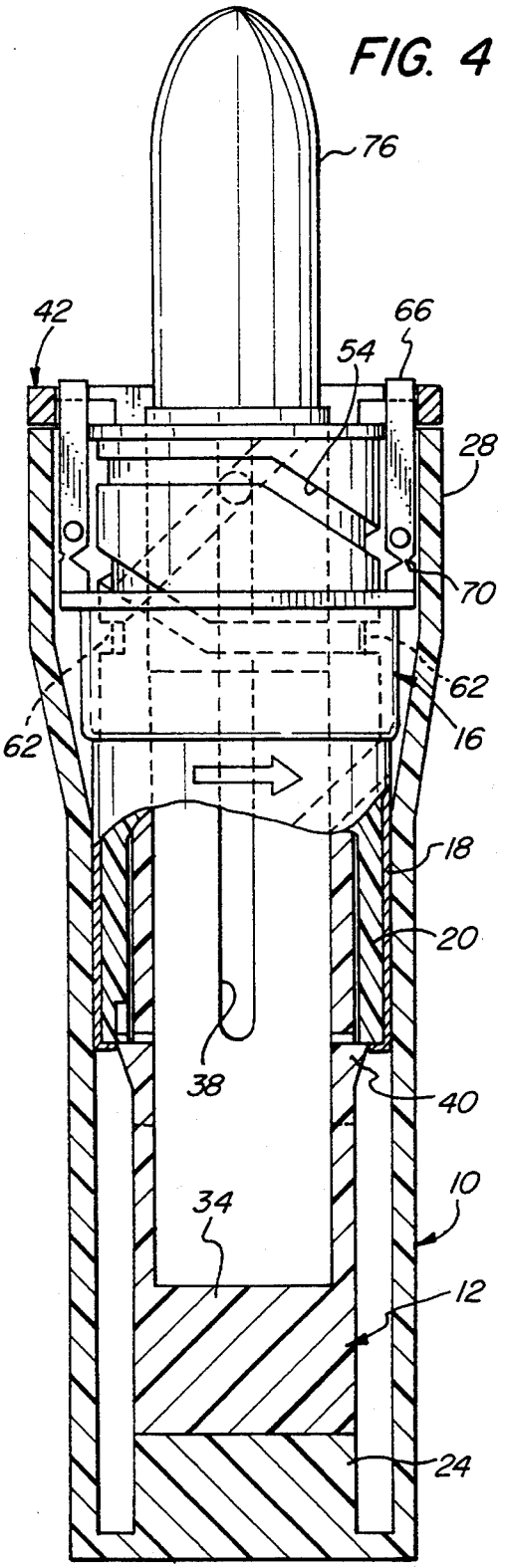
FIG. 4 is an elevational view thereof with the housing in section and portions of components broken away to reveal internal construction and with the lipstick fully extended.
Figure 5:
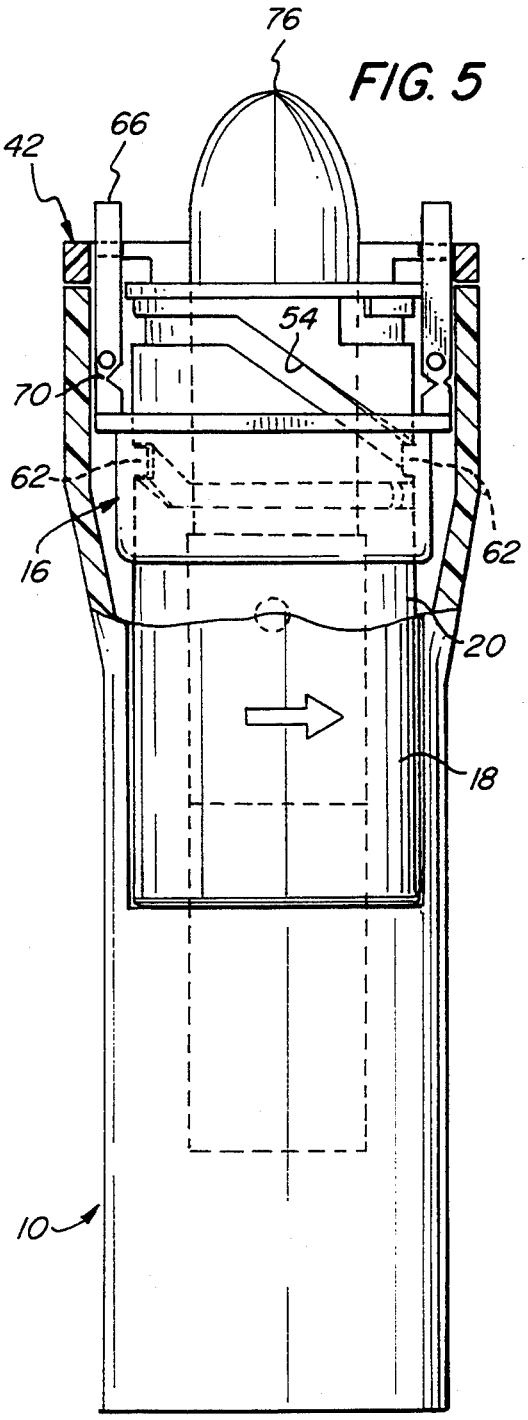
FIG. 5 is an elevational view in partial section showing the lipstick partially withdrawn into the holder.
Figure 6:
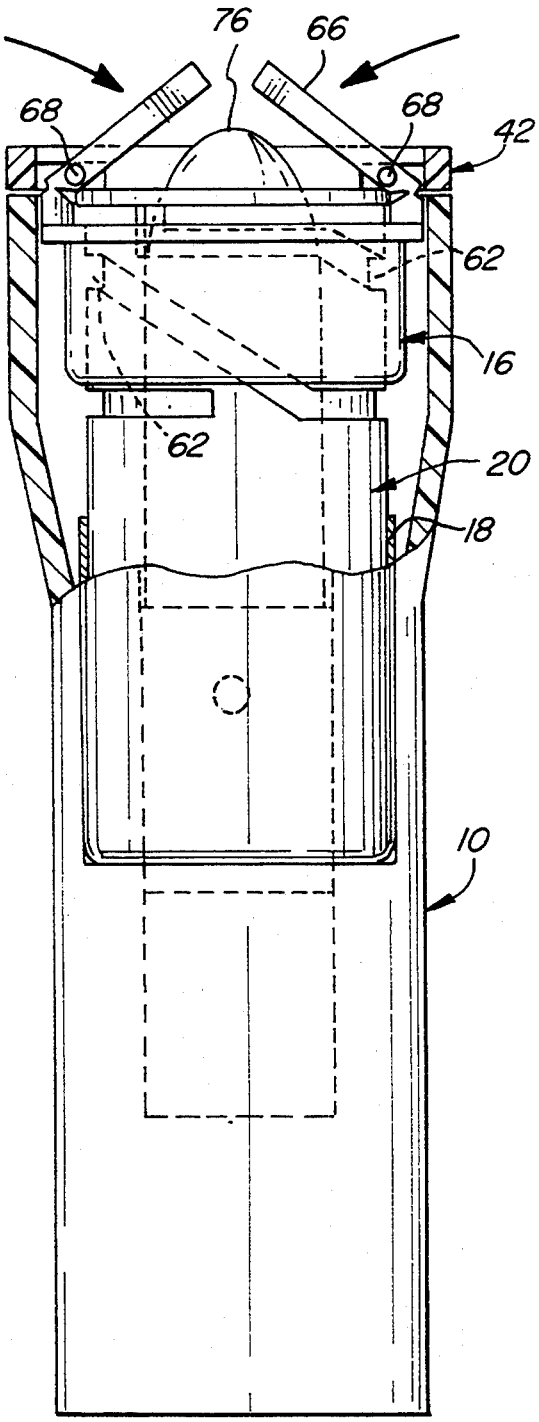
FIG. 6 is a similar view with the lipstick further withdrawn into the holder and the closure panels shown partially pivoted towards a closed position.
Figure 7:
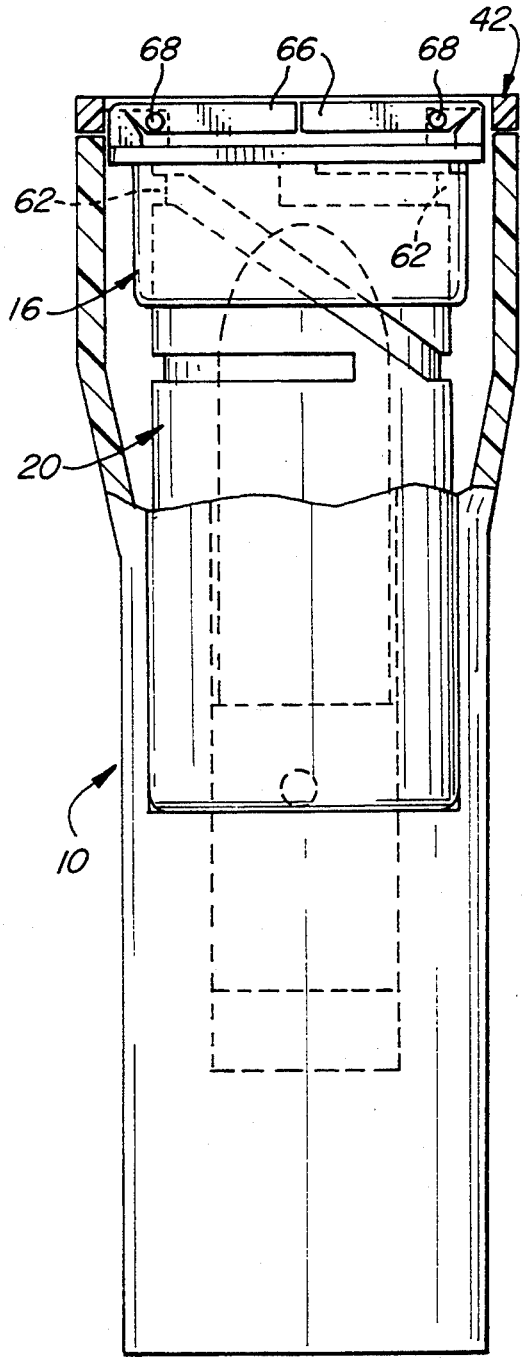
FIG. 7 is a similar view with the lipstick fully withdrawn and the closure panels fully closed.
Figure 8:
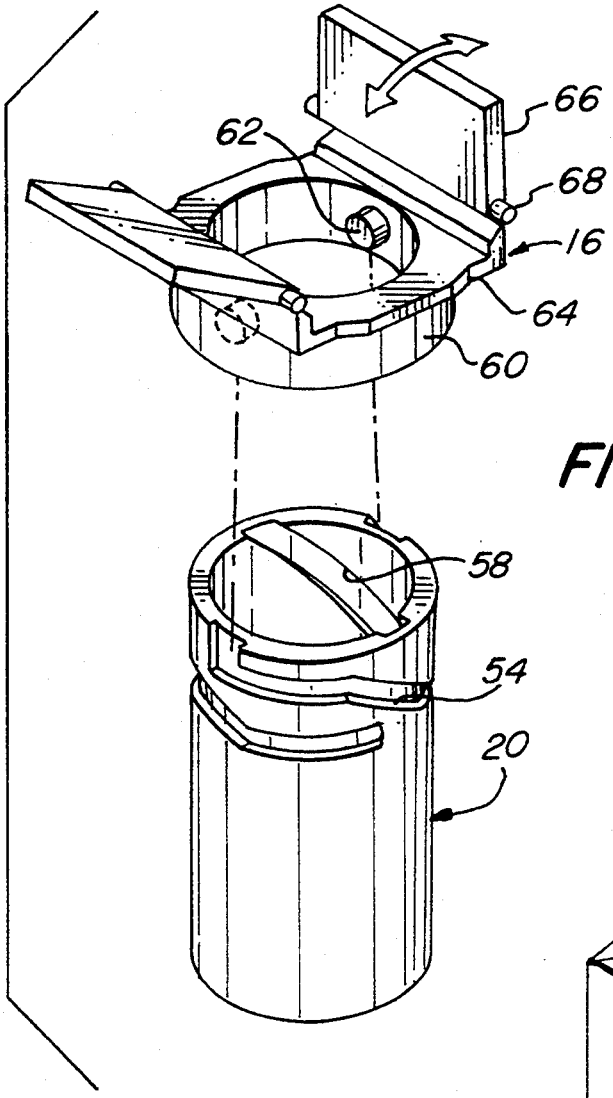
FIG. 8 is a fragmentary perspective view of the manipulatable member and closure member components.

As seen in FIG. 4, the parts are disposed in a position wherein the lipstick holder has its closure panels 66 fully opened and the lipstick 76 is projected outwardly therefrom. When the manipulatable member 20 (or sleeve 18) is rotated in the direction indicated by the arrows in FIGS. 4 and 5, this causes the carrier cup 16 to move downwardly within the spiral channel 58 while the closure member 16 is moved upwardly by reason of the engagement of its pins 62 in the channel 54. However, because the channel 54 has horizontally extending portions 56, there are periods in the rotation of the manipulatable member 20 in which there is no axial motion of the closure member 16 to allow for the differential in the extent of axial displacement desired between that of the carrier cup 14 and that of the closure member 16. As the closure member 16 is moved upwardly, the closure panels 66 project outwardly of the collar 42 and the pins 68 move into the slots 48 to allow the panels to pivot downwardly as shown in FIG. 6, and ultimately into the fully closed position seen in FIG. 7.

From this position, the rotation in the opposite direction will effect motion of the elements in the direction to achieve full opening as seen in FIG. 4.

The various components of the lipstick holder may be fabricated from metal, synthetic resins and ceramics depending upon the desired appearance and economic factors. Several components are most desirably fabricated from synthetic resin because of the ability to utilize the properties thereof such as the living hinge feature which is conveniently employed for the closure member to provide the pivotal connection between the closure panels and the collar in an integral component. Insofar as the synthetic resin components are concerned, these are conveniently fabricated by injection molding. However, extruded tubing may be utilized for some of the components and the various channels and slots can be readily machined therein. Stamping and casting operations are conveniently utilized for metal parts, and molding is generally required for ceramic parts.

The housing may have a configuration other than the rectangular configuration in the illustrated embodiment. Convenience of design and fabrication make a rectangular cross section desirable for at least the upper portion thereof, but even circular configurations may be employed with appropriate modification of the configuration of the closure panels. The housing may have a smooth external surface or a knurled or ribbed surface to facilitate gripping. In the illustrated embodiment, an ornamental sleeve is provided about the manipulatable member and it can also improve frictional engagement by providing it with a knurled or ribbed surface. This sleeve may be secured to the manipulatable member by adhesive bonding, staking or the like.

Although a single access aperture may be employed which will require operation by only one finger, a pair of access apertures is preferable since manipulation between a thumb and finger is much easier and desirable symmetry is achieved.

Thus, it can be seen from the foregoing detailed specification and attached drawings that the cosmetic lipstick holder of the present invention may be readily and economically fabricated from parts which may be readily fabricated. Only several components are required in accordance with the preferred construction, and these may be readily assembled. The configuration may be readily varied, and the external surface and appearance of the housing may be readily modified to provide highly pleasing variations in appearance.

Having thus described the invention, what is claimed is:

1. A cosmetic stick holder comprising;

(a) a housing with an opening at its upper end and having a base and a sidewall with at least one access aperture therein;

(b) a core member seated in said housing and having a generally circular cross section, said core member having;

(i) a base;

(ii) a generally cylindrical sidewall extending upwardly from said base and having at least one axially extending slot therein;

(iii) a collar at the upper end of said sidewall providing horizontal shoulders on opposite sides thereof with slots therein;

(c) a manipulatable tubular member rotatably disposed about said sidewall of said core member and manipulatable through said housing access aperture, said tubular member having a generally helical channel in its inner surface and a generally helical channel in its outer surface;

(d) a carrier cup of generally circular cross section disposed in said core member and having a base and a sidewall with a projection on its outer surface extending through said axially extending slot in said core member and slidably seated in said inner helical channel of said manipulatable member whereby rotation of said manipulatable member effects movement of said cup axially of said core member;

(e) a closure member having a cylindrical body portion slidable on the outer surface of said manipulatable member said body portion having a projection on its inner surface seated in said outer channel of said manipulatable member whereby rotation of said manipulatable member moves said closure member axially thereon in a direction opposite from that of the movement of said carrier cup, said closure member also having a peripheral collar portion at the upper end of said cylindrical body portion and closure panels pivotably supported on the upper surface of said collar portion, said panels extending through said slots in said collar of said core member and being dimensioned and configured to close said housing opening when pivoted into a horizontal position, movement of said closure member downwardly on said manipulatable member causing said closure panels to pivot into a vertical position and slide downwardly in said slots of said core member collar to expose said opening of said housing, said closure panels moving into a horizontal position upon movement of said closure member into its uppermost position to close said opening.

2. The cosmetic stick holder in accordance with claim 1 wherein said collar of said core member seats on the upper end of said sidewall of said housing.

3. The cosmetic stick holder in accordance with claim 2 wherein said collar has an upstanding wall extending about the periphery thereof and within which said closure panels seat in the horizontal position thereof.

4. The cosmetic stick holder in accordance with claim 3 wherein the upper portion of said housing has a rectangular cross section and said collar of said core member is of cooperating rectangular configuration.

5. The cosmetic stick holder in accordance with claim 1 wherein said sidewall of said core member includes means for rotatably supporting said manipulatable member thereon.

6. The cosmetic stick holder in accordance with claim 5 wherein said supporting means comprises tabs projecting outwardly thereof on which said manipulatable member seats.

7. The cosmetic stick holder in accordance with claim 1 wherein said core member has a pair of diametrically spaced axially extending slots and said carrier cup has a pair of diametrically spaced projections thereon extending through said pair of slots.

8. The cosmetic stick holder in accordance with claim 1 wherein said sidewall of said housing has a pair of opposed access apertures.

9. The cosmetic stick holder in accordance with claim 1 wherein there is included means for securing said core member in said housing.

10. The cosmetic stick holder in accordance with claim 9 wherein said securing means is adhesive.

11. The cosmetic stick holder in accordance with claim 1 wherein said closure member collar portion has upstanding ribs thereon upon which said closure panels are pivotably supported.

12. The cosmetic stick holder in accordance with claim 1 wherein said closure panels have projections on the sides thereof which are movable in horizontal slots in said collar of said core member during pivoting thereof between opening and closing positions.

13. The cosmetic stick holder in accordance with claim 1 wherein said outer helical channel of said manipulatable member has at least one horizontal portion to stall axial motion of said closure member during rotation of said manipulatable member.

14. A cosmetic stick holder comprising;

(a) a housing with an opening at its upper end and having a base wall and a sidewall with a pair of oppositely spaced access apertures therein;

(b) a core member seated in said housing and having a generally circular cross section, said core member having;

(i) a base;

(ii) a generally cylindrical sidewall extending upwardly from said base and having a pair of diametrically spaced axially extending slots therein; and (iii) a collar at the upper end of said sidewall providing horizontal shoulders on opposite sides thereof with slots therein, said collar seating on the upper end of said sidewall of said housing, the upper portion of said housing having a rectangular cross section and said collar of said core member having a cooperating rectangular configuration;

(c) a manipulatable tubular member rotatably disposed about said sidewall of said core member and manipulatable through said housing access apertures, said tubular member having a generally helical channel in its inner surface and a generally helical channel in its outer surface;

(d) a carrier cup of generally circular cross section disposed in said core member and having a base and a sidewall with a pair of diametrically spaced projections on its outer surface extending through said axially extending slots in said core member and slidably seated in said inner helical channel of said manipulatable member whereby rotation of said manipulatable member effects movement of said cup axially of said core member;

(e) a closure member having a cylindrical body portion slidable on the outer surface of said manipulatable member, said body portion having a projection on its inner surface seated in said outer channel of said manipulatable member whereby rotation of said manipulatable member moves said closure member axially thereon in a direction opposite from that of the movement of said carrier cup, said closure member also having a peripheral collar portion at the upper end of said cylindrical body portion and closure panels pivotably supported on the upper surface of said collar portion, said panels extending through said slots in said collar of said core member and being dimensioned and configured to close said housing opening when pivoted into a horizontal position, movement of said closure member downwardly on said manipulatable member causing said closure panels to pivot into a vertical position and slide downwardly in said slots of said core member collar to expose said opening of said housing, said closure panels moving into a horizontal position upon movement of said closure member into its uppermost position to close said opening.

15. The cosmetic stick holder in accordance with claim 14 wherein said collar has an upstanding wall extending about the periphery thereof and within which said closure panels seat in the horizontal position thereof, and wherein said sidewall of said core member includes means for rotatably supporting said manipulatable member thereon.

16. The cosmetic stick holder in accordance with claim 15 wherein said supporting means comprises tabs projecting outwardly of said core sidewall on which said manipulatable member seats.

17. The cosmetic stick holder in accordance with claim 14 wherein said closure member collar has upstanding ribs thereon upon which said closure panels are pivotably supported and said closure panels have projections on the sides thereof which are movable in horizontal slots in said collar of said core member during pivoting thereof between opening and closing positions.

18. The cosmetic stick holder in accordance with claim 14 wherein said outer helical channel of said manipulatable member has at least one horizontal portion to stall axial motion of said closure member during rotation of said manipulatable member.

* * * * *